United States Patent [19]

Toriyama

[11] Patent Number: 4,629,445

[45] Date of Patent: Dec. 16, 1986

[54] APPARATUS FOR FOLDING REAR PORTION OF CASE BLANK

[75] Inventor: Daigoro Toriyama, Nagareyama, Japan

[73] Assignee: Tanabe Machinery Co., Ltd., Tokyo, Japan

[21] Appl. No.: 640,597

[22] Filed: Aug. 14, 1984

[51] Int. Cl.[4] ..... B31B 1/00

[52] U.S. Cl. ..... 493/10; 493/177; 493/409; 493/417; 493/425; 493/453

[58] Field of Search ..... 493/10, 8, 11, 13, 14, 493/21, 23, 127, 166, 176, 425, 453, 454, 417, 424, 409, 177

[56] References Cited

U.S. PATENT DOCUMENTS

| | | | |
|---|---|---|---|
| 2,883,917 | 4/1959 | Labonbard | 493/453 |
| 3,901,134 | 8/1975 | Reizenstein et al. | 493/10 |
| 4,119,018 | 10/1978 | Nava | 493/10 |
| 4,432,745 | 2/1984 | Eldridge | 493/10 |

*Primary Examiner*—Francis S. Husar
*Assistant Examiner*—Robert Showalter
*Attorney, Agent, or Firm*—Wenderoth, Lind & Ponack

[57] ABSTRACT

A case making machine is provided with an apparatus for folding rear portion of a feeding case blank and the apparatus comprises a claw mechanism for folding the rear portion of the case blank along the folding line. The claw mechanism is rotated at an angular speed which is changed by a cam mechanism operated by a driving source through a drive shaft and a link mechanism. An electromagnetic valve is further provided for controlling the operation of the claw mechanism. The valve is actuated by an electric circuit such that the electromagnetic valve can be operated in synchrony with the advancing speed of the blank. This result is achieved by increasing pulse numbers inputted into the circuit to account for the rise time interval of the electromagnetic valve.

6 Claims, 5 Drawing Figures

APPARATUS FOR FOLDING REAR PORTION OF CASE BLANK

BACKGROUND OF THE INVENTION

This invention relates to an apparatus adapted for a case making machine which folds a rear portion of an advancing case blank, held between a pair of conveying belts, along a folding line.

Bilateral portions of a case blank, which is under a feeding condition, are relatively easily foldable by a prior art technique of this field, but it is considerably more difficult to fold a rear portion of an advancing or running blank along the folding line because it is hard to synchronize folding the rear portion of the blank in time with the running speed thereof.

For example, in the specification of U.S. Pat. No. 3,901,134, there is disclosed an apparatus for folding the rear portion of a blank, in which claw means for folding the blank is attached to a chain and performs the folding operation while travelling with the chain. This structure is very complicated and is liable to cause miss-folding of the blank.

SUMMARY OF THE INVENTION

An object of this invention is to provide an apparatus adapted for a case making machine, for folding a rear portion of a case blank, the apparatus having a simple structure which overcomes the problems of the prior art.

Another object of this invention is to provide a claw mechanism of the appartus for folding the rear portion of the blank wherein the claw mechanism is rotated at different angular speeds regardless of the feeding speed of the blank.

According to this invention, there is provided an apparatus, adapted for a case making machine, for folding a rear portion of a case blank along a predetermined folding line comprising a claw mechanism secured to a rotation shaft which is rotatably supported by a frame of the case making machine, a cam mechanism connected to the claw mechanism through the rotation shaft adapted to change an angular speed of the claw mechanism, an electromagnetically actuated valve, called an electromagnetic valve hereinafter operatively connected to the rotation shaft for controlling the operation of the claw mechanism, and an electric circuit means operatively connected to the electromagnetic valve so that the electromagnetic valve can be operated in synchronism with the advancing speed of the blank by increasing pulse numbers inputted into a counter of the electric circuit for operating the electromagnetic valve to compensate for the rise time interval of the electromagnetic.

According to the invention apparatus having the construction described above can accurately fold the rear portion of the running blank along the predetermined folding line regardless of the running speed of the blank or the timing of the blank feeding. These results are achieved by folding the rear portion of the blank with a claw mechanism, the angular speed of which is changed by utilizing a cam mechanism.

BRIEF DESCRIPTION OF THE DRAWINGS

In the accompanying drawings:

FIG. 6 shows a block diagram of an electric circuit for controlling the operation of a claw mechanism for folding a rear portion of a case blank.

DESCRIPTION OF THE PREFERRED EMBODIMENT

Figure 1:
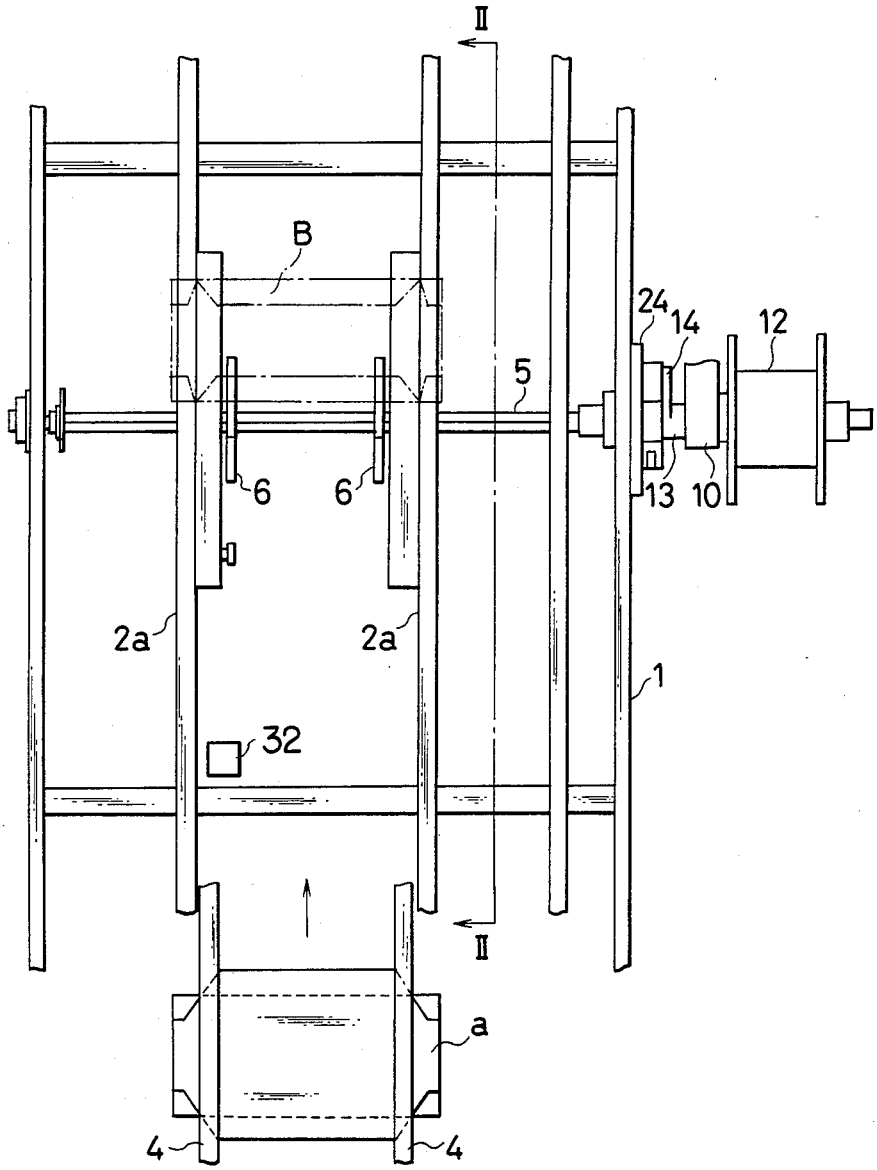
FIG. 1 shows a plane view of an apparatus for folding a rear portion of a case blank according to this invention, which apparatus is adapted for a case making machine.
Figure 2:
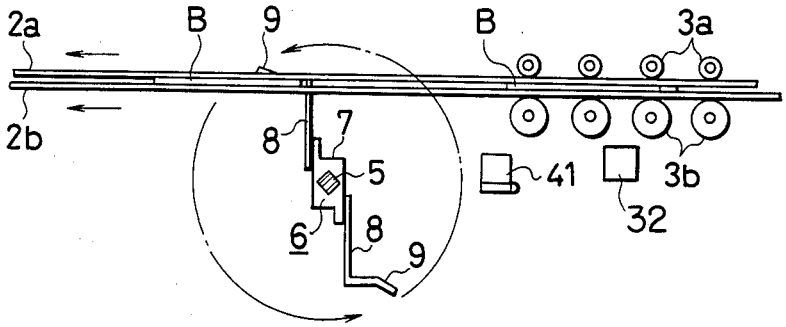
FIG. 2 shows a side view of the apparatus shown in FIG. 1 taken along the line II—II.

Referring to FIGS. 1 and 2, which respectively show plane and side views of an apparatus for folding a rear portion of a case blank, a pair of upper belts 2*a* and a pair of lower belts 2b for conveying case blanks are disposed on a frame 1 of a case making machine. The conveying belts 2*a* and 2*b* are held by a plurality of belt pressing rollers 3*a* and 3*b* which are located on upper and lower sides of the belts 2*a* and 2*b* so that the case blank B is held between the belts 2*a* and 2*b* as shown in FIG. 2. The blank B is fed therebetween from conveying belts 4 located in line with the belts 2*a* and 2*b*.

Figure 3:
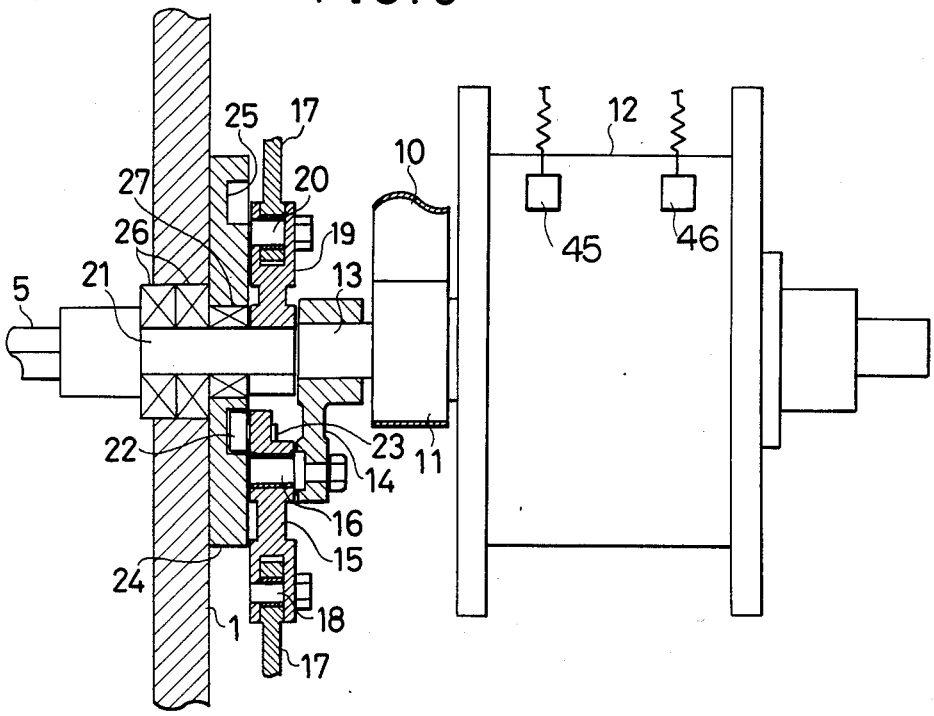
FIG. 3 is an enlarged view of a drive mechanism, partially in cross section, shown in FIG. 1.

A rotation shaft, preferably for example a square shaft 5, is supported at the lower portion of the frame 1 below the belts 2*a* and 2*b* and is rotatable in a direction normal to the blank conveying direction. Claw mechanism 6, 6 for folding the rear portion of the running blank B are attached to the square shaft 5 in bilaterally spaced relationship. Each claw mechanism 6 is provided with a base portion 7 fitted to the square shaft 5 for rotation therewith. A pair of L-shaped claws 8, 8 are attached to opposite sides of the base portion 7 so as to extend upwardly and downwardly therefrom. The extending front ends of the claws 8, 8 are bent slightly to form inclined operating members 9, respectively, which are to be positioned above the blank B in accordance with the rotation of the square shaft 5 to thereby fold a rear portion of the blank B. The claw mechanism 6 is constructed so that an image line connecting the front ends of both operating members 9, 9 passes around the center of the square shaft 5, which is driven by an electric motor, not shown. That is, as shown in FIG. 3, a belt 10 wound around a pulley 11 is rotated by the operation of the motor and the rotation of the pulley 11, by belt 10, is transmitted to a driving shaft 13 coaxially arranged with the square shaft 5 through a pneumatically actuated clutch 12, called air clutch hereinafter. The ON-OFF control of the air clutch 12 is performed by an electromagnetic valve, (45) of a known type which is understood by those skilled in the art, described in detail hereinafter. The running speed of the belt 10 can be changed in response to the running, i.e. feeding, speed of the blank B.

Figure 4:
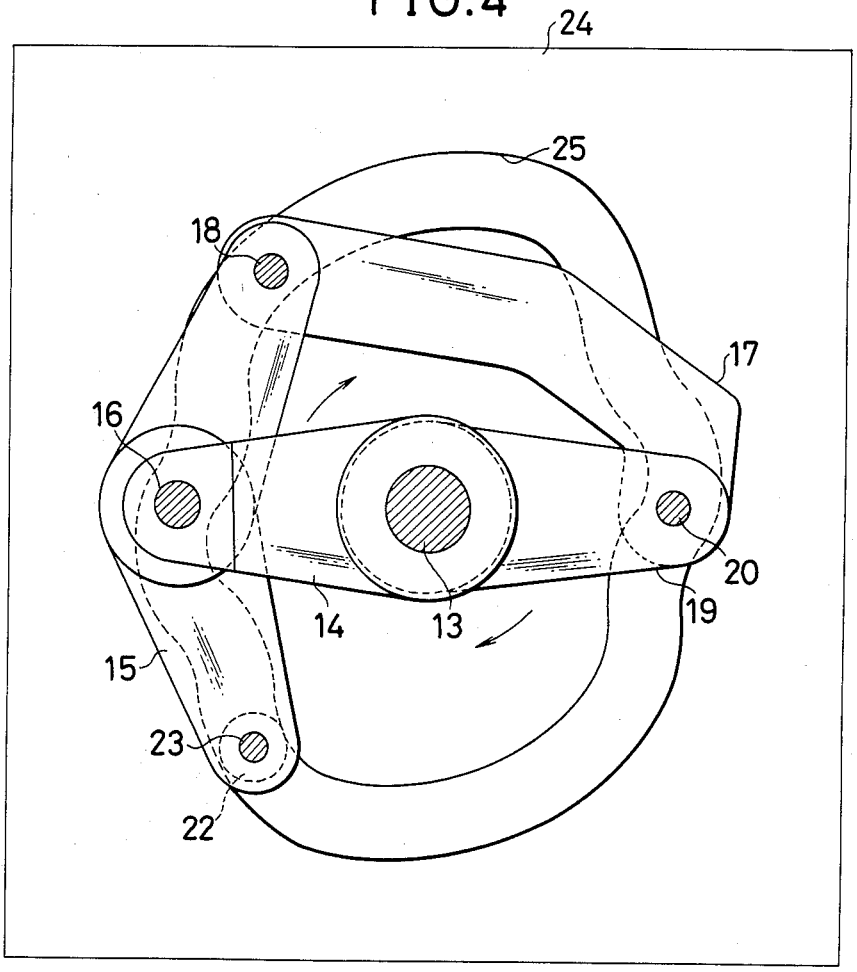
FIG. 4 is an enlarged front view showing a link mechanism and a cam shown in FIG. 3.

As shown in FIG. 4, one end of the first link 14 is fitted into the driving shaft 13, and an intermediate portion of the second link 15 formed in substantially bow shape is pivoted by pin 16 to the other end of the first link 14. One end of the second link 15 is pivotably attached by a pin 18 to one end of a third link 17 which is substantially L-shaped. One end of a fourth link 19 is pivotted by a pin 20 to the other end of the third link 17. The other end of the fourth link 19 is fitted to a circular base portion 21 at one end of the square shaft 5. A cam follower 22 is rotatably projected from the other end of the second link 15 through a pin 23 and the cam follower 22 is received in a groove 25 of a grooved cam 24 supported by the frame 1.

Figure 5:
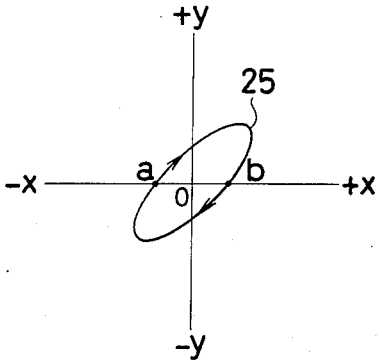
FIG. 5 shows a sketch for explaining the movement of a cam follower.

Although the cam groove 25, shown in FIG. 4, has a complicated shape for changing the angular speed of the square shaft 5 with respect to the rotation of the driving shaft 13, which is driven at a constant-angular speed, any shape can be used as long as when the claw 8 is rotated by 180°, for folding the the rear portion of one blank B, the claw 8 is first rotated by a relatively large angular speed , for securely folding the rear portion of the running blank B, and then by a relatively small angular speed, so as to sink below the plane on which the blank B is positioned after the blank has completely passed the blank folding position. Accordingly, the cam groove 25 may be constructed in an elliptical shape as shown in FIG. 5 so that the cam follower 22 moves from the point a to the point b and then from the point b to the point a along the arrowed directions by half circles, respectively. In other words, as will be understood from FIG. 5, since the time required for the cam follower 22 to pass the second (+x,−y) and fourth (+x,−y) quadrants of the graph shown in FIG. 5 is short, the angular speed of the claw 8 at these portions is high to thereby effectively carry out the folding operation of the rear portion of the blank, and on the contrary, the time required for the cam follower 22 to pass the first (+x,+y) and third (−x,−y) quadrants of the graph is relatively long, so that the angular speed of the claw 8 at two of these portions in each quadrant is low, whereby situations where the blank B is not disengaged from the claw 8 are avoided.

The circular base 21 of the square shaft 5 is supported by bearings 26 and 27 provided in the frame 1 and the grooved cam 24.

It will of course be understood that the operation of the claw 8 for folding the rear portion of the blank B should by synchronous with the movement of the blank B. For this reason, a sensor (32) is provided for detecting the passing of the blank B in the case making machine. A distance between the sensor and an electromagnetic valve, required for switching "ON" the air clutch 12, is preliminarily inputted into a counter. Pulses are counted from a time when the front end of the blank B passes the sensor and when the counted number of pulses , corresponding to the distance between the sensor and the electromagnetic valve, is reached, an output signal representing this fact is generated from the counter to thereby switch on the electromagnetic valve.

A predetermind time interval, which is called a rise time (time contact), is generally required for starting the mechanical operation of the electromagnetic valve after an electric signal has been inputted into the electromagnetic valve from the counter. In case, for example, it is predetermined that the rise time of the electromagnetic valve is 0.05 sec. and one pulse is counted for the movement of 1 mm of the blank B a delay of, 5 pulses is caused for the electromagnetic valve when the blank B is moved at 100 mm/sec. and a delay of 50 pulses is caused therefor when the blank B is moved at 1000 mm/sec.

In order to obviate these defects, according to this invention, a timer, which has the same rise time as that of the electromagnetic valve, is operated to input into the counter twice as many pulses than those usually inputted into the counter for the time rise interval, thus preventing delayed operation of the electromagnetic valve. This function will be described in detail hereinafter in conjunction with FIG. 6, which shows electric circuit therefor.

Referring to FIG. 6, a pulse from a rotary type encoder 30 is inputted into a gate control circuit 31. When the front end of the moving blank B is detected by a sensor 32 , which utilizes an infrared ray, a signal from the sensor 32 representing this fact is inputted into a timer 33 into which the rise time of the electromagnetic valve is preset. An output signal from the timer 33 is inputted into an AND circuit 34 of the gate control circuit 31 and also inputted into an AND circuit 36 through an inverter 35. To these AND circuits 34 and 36 are inputted pulses from the encoder 30 and the output signal from the AND circuit 34 is inputted into a circuit 37 for multiplying twice the pulses therefrom.

Output signals from the AND circuit 36 and the circuit 37 are both inputted into an OR circuit 38 and an output signal from the OR circuit 38 is inputted into a preset counter 40, into which the pulse numbers representing the distance between the sensor 32 and the operating point of the electromagnetic valve had already been inputted by a digital switch 39. The counter 40 generates a signal to an OR circuit 42 when pulse numbers from the OR circuit 38 corresponds with the pulse numbers set in the counter 40. To the OR circuit 42 is inputted a signal from a limit switch 41 utilizing an infrared ray for stopping the claw 8 at a predetermined position for folding the rear portion of the blank.

An output signal from the OR circuit 42 is inputted into a driver 44 through an inverter 43 thereby to carry out the open-close controls of an electromagnetic valve 45 for switching on or off the air clutch 12 and of an electromagnetic valve 46 for switching on or off an air brake for operation of the claw 8 in folding the rear portion of the blank. Thus, as stated hereinbefore, the pulse numbers representing the distances between the sensor 32 and the positions of the blank B at which the electromagnetic valves 45 and 46 are operated had already been inputted into the counter 40 by the operation of the digital switch 39. The rise times of the electromagnetic valves 45 and 46 had also been inputted into the timer 33.

According to the construction of the electric circuit means shown in FIG. 6, when the advancing end of the blank B held by the belts 2*a* and 2*b* passes the portion at which the sensor 32 is disposed, the sensor 32 detects this fact and generates a signal to the timer 33, which then transmits a signal to the AND circuit 34 by the rise times of the electromagnetic valves 45 and 46. However, to the AND circuit 34 is inputted pulse numbers, for example one pulse with respect to the 1 mm movement of the blank B, from the encoder 30, so that the numbers of the pulses are multiplied twice by the circuit 37 to compensate for the rise time of the electromagnetic valve and the multiplied pulses are inputted from the OR circuit 38 into the counter 40 and added therein successively. After the time lapse of the rise time due to the timer 33, the signal from the timer 33 is inputted into the other AND circuit 36 through the inverter 35 and pulses generated from the encoder 30 are inputted as they are, without being multiplied, into the OR circuit 38, then into the counter 40, in which the pulses are successively added. When the added pulse numbers reach a predetermined pulse number, the counter 40 transmits a signal representing this fact and that signal is inputted into the OR circuit 42 and the driver 44 through the inverter 43 thereby to release the brake for the claw 8 and switch on the air clutch 12 to then rotate the claw 8 for folding the rear portion of the blank B. The timing between the rotating operation of the claw 8 and the feeding movement of the blank B can be completely synchronized by multiplying twice the pulse numbers during the rise times of the electromagnetic valves 45 and 46 for driving the claw 8 to prevent the delayed mechanical operation of the electromagnetic valves 45 and 46. Accordingly, since the angular speed of the claw 8 is controlled to be first high and finally low during the rotation thereof by means of the cam 24, when it rotates by 180°, the rear portion of the blank B can preferably be folded along the folding line.

The 180°-rotation of the claw 8 is detected by the limit switch 41 and the detected signal is inputted into the OR circuit 42 and then the driver 44 through the inverter 43. The driver 44 actuates the electromagnetic valves 45 and 46 to switch off the pneumatically actuated air clutch 12 and switch on the pneumatically actuated brake, respectivelly, thus rapidly finishing the rotating operation of the claw 8 for folding the rear portion of the blank.

After passing the blank B with the folded rear portion, when the advancing end of the succeeding blank B passes the sensor 32, the claw 8 is rotated by 180° by the manner described hereinbefore with respect to the proceeding blank B to fold the rear portion of the succeeding blank B along the folding line.

According to this invention, the rear portion of a case blank can be accurately folded along the folding line regardless of the feeding speed thereof or the timing from the blank feeding time.

What is claimed is:

1. An apparatus for folding a rear portion of an advancing case blank along a predetermined folding line comprising:

a frame;

a rotation shaft rotatably supported by said frame;

a claw means secured to said rotation shaft, said claw means rotatable by said rotation shaft for folding a rear portion of an advancing case blank on said frame;

a cam mechanism attached to said rotation shaft for causing the angular speed of said claw means to change through a rotation of 180°, said cam mechanism including a link mechanism and a cam supported on said frame, said cam having a cam groove therein which has a configuration which causes said claw means to have a high angular speed for folding the rear portion of an advancing case blank followed by a low angular speed for sinking said claw means below the path of a case blank after the blank has been folded and moved away from the claw means, said link mechanism comprising a cam follower which is slidable in said cam groove, a first link connected at one end to an intermediate portion of a second link, said cam follower projecting from one end of said second link, a third link connected at one end thereof to the other end of said second link and a fourth link connected at one end thereof to the other end of said third link, said other end of said fourth link connected to said rotation shaft;

driving means connected to said cam mechanism, said driving means including a drive shaft which is rotated at a constant angular speed and is connected to the other end of said first link;

a pneumatically actuated clutch and a pneumatically actuated brake connected to said driving means for causing rotation of said rotation shaft and stopping rotation of said rotation shaft, respectively;

electromagnetically actuated valve means connected to said pneumatically actuated clutch and said pneumatically actuated brake for causing operation of said pneumatically actuated clutch and said pneumatically actuated brake; and an electric circuit means operatively connected to said electromagnetically actuated valve means and operatively connected to sensor means for detecting an advancing case blank, said electric circuit means causing rotation of said claw means in snychronism with the advancing speed of a case blank, said electric circuit means compensating for the rise time of said electromagnetically actuated valve means by providing increased pulse numbers to be counted in said electric circuit means.

2. The apparatus according to claim 1 wherein said rotation shaft comprises a square shaft.

3. The apparatus according to claim 1 wherein said claw means comprises a base portion rotated together with said rotation shaft, and a pair of substantially L-shaped claws consisting of a pair of straight portions extending in opposing directions from said base portion and a pair of projections extending in an inclined manner from the front ends of said straight portions respectively for folding the rear portion of the blank when said claw means is rotated.

4. The apparatus according to claim 1 wherein said cam groove is formed to have an elliptical shape so as to change said angular speed difference of said claw means.

5. The apparatus according to claim 1 wherein said electric circuit means includes a timer having the same rise time as the rise time of said electromagnetic valve and a counter into which increased pulse numbers are inputted in response to the operation of said timer for controlling the operation of said electromagnetic valve.

6. The apparatus of claim 1 wherein said cam groove has a shape which causes the claw means to have an initial high angular speed at one portion of said cam groove followed by a low angular speed at two portions of said cam groove during a rotation of said claw means through 180°.

* * * * *